US006663544B2

(12) United States Patent
Hinds

(10) Patent No.: US 6,663,544 B2
(45) **Date of Patent: *Dec. 16, 2003**

(54) IMPINGER FOR STRAPPED HANDGRIP

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 237 days.

This patent is subject to a terminal disclaimer.

(21) Appl. No.: 09/952,557

(22) Filed: Sep. 14, 2001

(65) Prior Publication Data

US 2002/0052270 A1 May 2, 2002

Related U.S. Application Data

(63) Continuation-in-part of application No. 09/388,228, filed on Sep. 1, 1999, which is a continuation-in-part of application No. 09/243,087, filed on Feb. 2, 1999, now abandoned.

(51) Int. Cl.[7] ..... A63B 21/00

(52) U.S. Cl. ..... 482/126; 482/121; 482/44

(58) Field of Search ..... 482/121, 126, 482/124, 139, 141, 49, 904, 907, 148, 129; D21/692, 691

(56) References Cited

U.S. PATENT DOCUMENTS

| | | | |
|---|---|---|---|
| 196,324 | A | 10/1877 | Barnett |
| 232,579 | A | 9/1880 | Weeks |
| 1,112,114 | A | 9/1914 | Caines |
| 1,965,511 | A | 7/1934 | Preston |
| 2,930,614 | A | 3/1960 | McIntosh |
| 4,109,907 | A | 8/1978 | Zito |
| 4,779,867 | A | 10/1988 | Hinds |
| 5,505,677 | A | 4/1996 | Hinds |
| 5,549,532 | A | 8/1996 | Kropp |
| 5,681,248 | A | 10/1997 | Vani |
| 5,894,631 | A | 4/1999 | Chiu |

FOREIGN PATENT DOCUMENTS

| | | |
|---|---|---|
| GB | 27611 | of 1899 |
| GB | 16404 | of 1900 |

*Primary Examiner*—Jerome W. Donnelly

(57) ABSTRACT

A strapped exercise assembly comprising an impinger which seats in a channel nest, part of a channel within a connection bar so that the operator can quickly adjust the length of an elastic cord, strap or sheet used for the exercise or substitute one such member for another. The impinger is shaped to fit snugly within the channel to hold the elastic cord or other member in place. The connection bar has two strap channels to form the hand held part of the handgrip but no securing channels for the cord or other elastic member, simplifying the structure from that of another assembly which otherwise has many similar features.

12 Claims, 6 Drawing Sheets

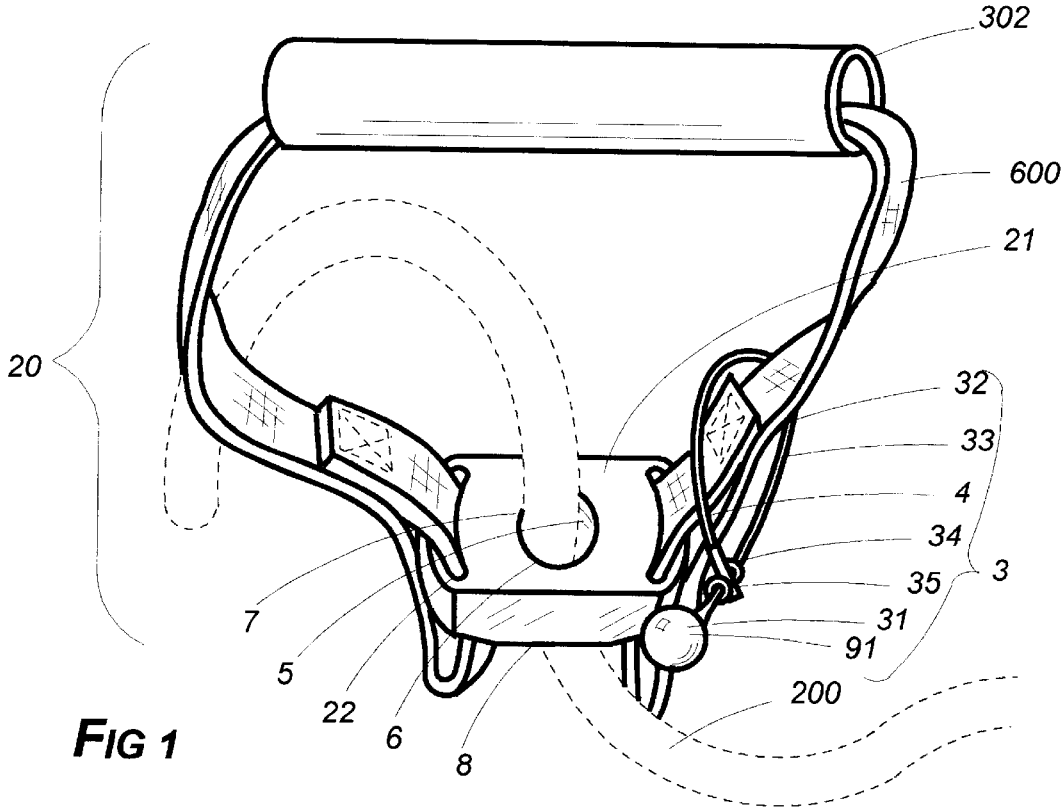
FIG 1
FIG 2
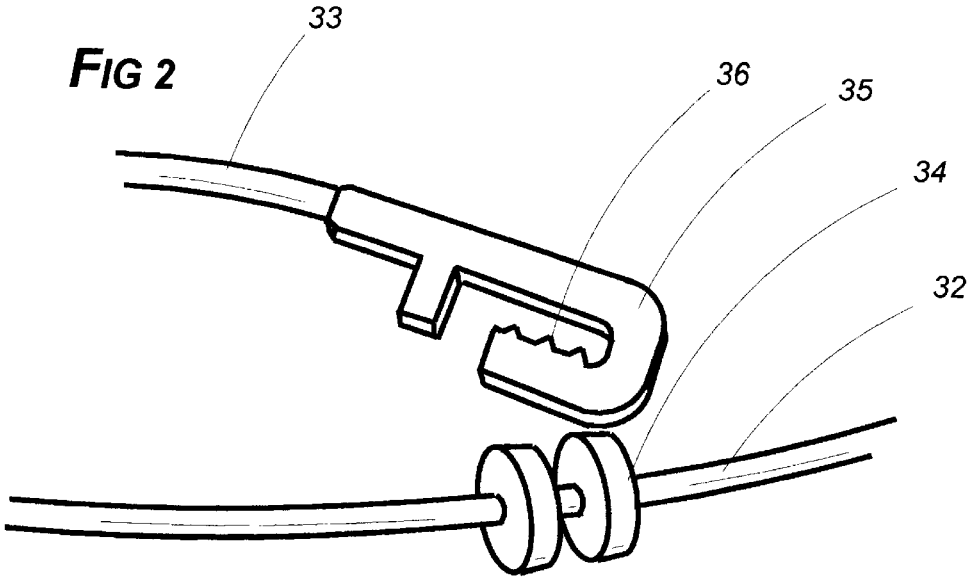

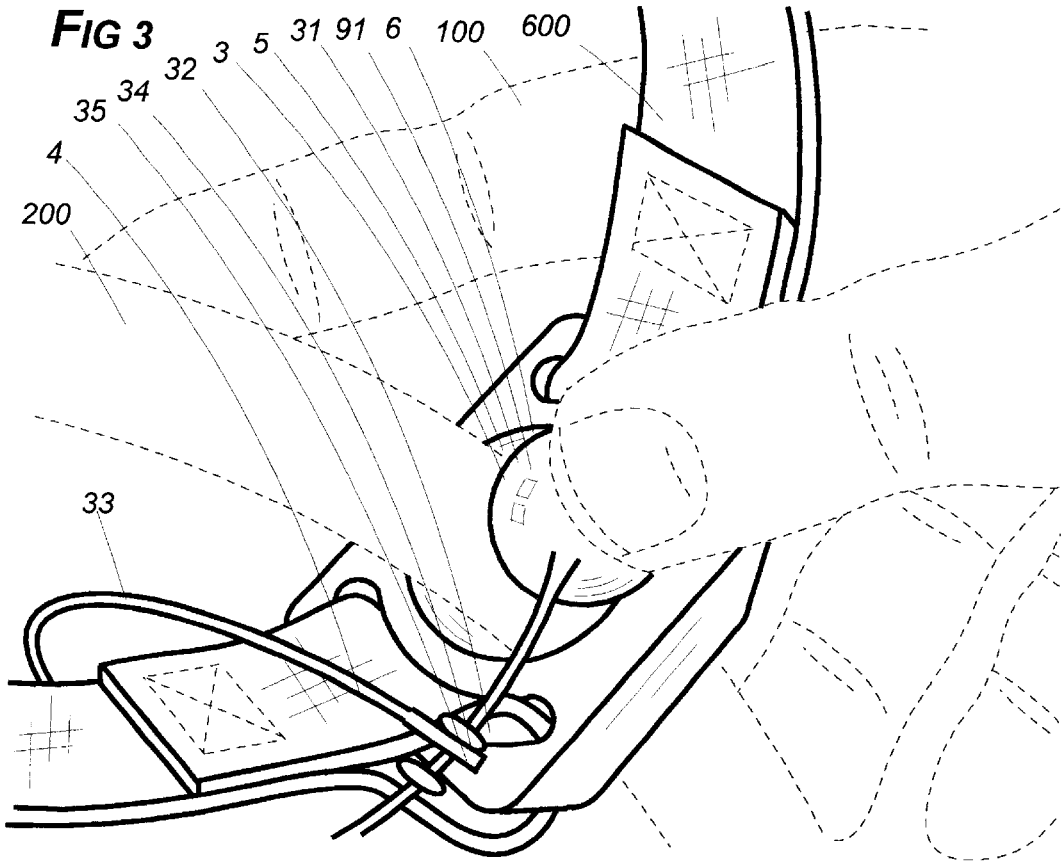
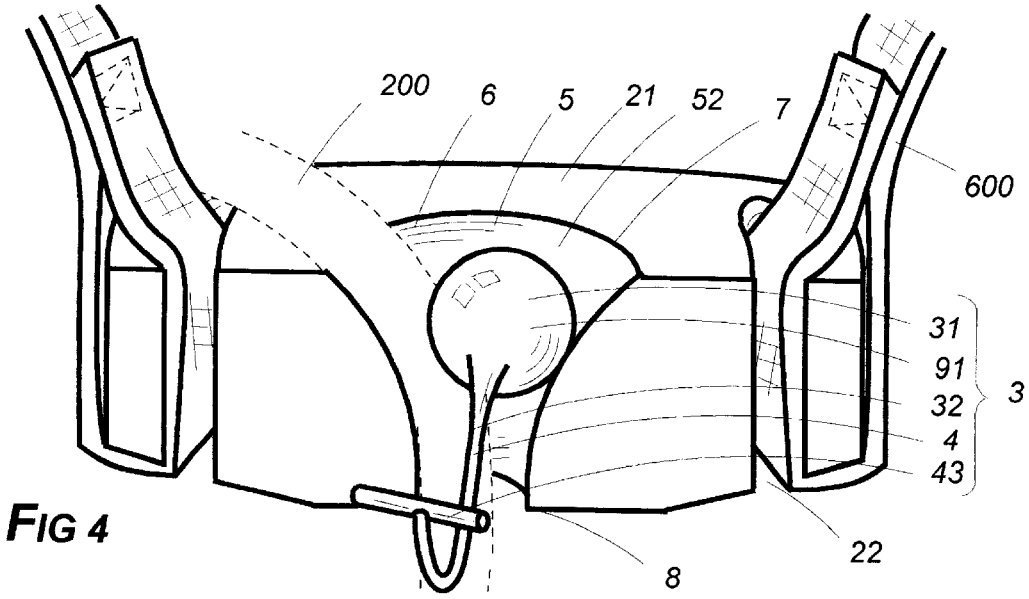
FIG 4

IMPINGER FOR STRAPPED HANDGRIP

This instrument, filed under 37 CFR 1.53(b) and 1.78, invoking the provisions of 35 U.S.C. 120, is a Continuation-in-Part of presently application Ser. No. 09/388,228 entitled "Adjustable Exercise Handgrip Assembly", filed Sep. 1, 1999 which, in turn, is a Continuation-in-Part of application Ser. No. 09/243,087 entitled "Quick Adjustment Handle for Exercise Cable", filed Feb. 2, 1999, since abandoned.

BACKGROUND OF THE INVENTION

1. Field of the Invention

Exercise equipment

2. Description of the Prior Art

Occasionally a descriptive term in this application may be shortened so as to recite only a part rather than the entirety thereof as a matter of convenience and to avoid needless redundancy. In instances in which that is done, applicant intends that the same meaning be afforded each manner of expression. Thus, the term elastic member impinger tethering loop (33) might be used in one instance but in another, if meaning is otherwise clear from context, expression might be shortened to impinger tethering loop (33) or merely loop (33). Any of those forms is intended to convey the same meaning.

The term attach or fasten or any of their forms when so used means that the juncture is of a more or less permanent nature, such as might be accomplished by nails, screws, welds or adhesives. Thus it is stated herein that handgrip strapping (600), stitched in fastening loops at its (600) ends, is attached to the connection bar (21). A connection in which one object is easily removed from another is described by the word emplace, as where it is stated herein that an impinger (3) is emplaced in the channel nest (5) before tugging an elastic member (200, 201, 202) against it (3). A connection in which two objects, although not attached could be separated only with considerable difficulty is referred to herein as one of rigid emplacement The pressured fitting of the impinging plug (500) within the exercise cord (200) is stated herein to be such a connection. Employment of the words connector join or any of their forms is intended to include the meaning of any of those terms in a more general way. The meaning in the respective cases is clear from context, however. Accordingly, modifying words to clarify which of the two uses is the intended one seem unnecessary.

The word comprise may be construed in any one of two ways herein. A term used to describe a given object is said to comprise it, thereby characterizing it with equivalency in meaning for the term. Thus, it is stated that in FIG. 5, the elastic member addressed comprises an elastic exercise strap (202), meaning that in the given instance, that object is the type of elastic exercise member impinged. However, the word comprise may also be used to describe a feature which is part of the structure or composition of a given object. Thus, the impinger (3) is stated to comprise, among other things, an impinger head (31) as a feature thereof.

Terms relating to physical orientation such as top or bottom, upper or lower, refer to the positioning of the assembly (20) such that, as a matter of convenience in discussing orientation and as shown in the drawings, the handhold (302) is observed at the top with the elastic exercise member (200, 201, 202) running from the exterior channel end (7) at the bottom.

The term longitudinal refers to generally elongated configuration. Thus, a given embodiment of the impinger head (31) is stated to lack longitudinal symmetry, as in the case of the ovate shaped (94) version, or to be longitudinally curved, as in the case of that which is bean shaped (95).

Certain words have been coined herein to simplify discussion. Thus, a curved surface is occasionally spoken of as comprising arcuitry, thereby transposing the adjective arcuate into a noun. When convenient and appearing to be appropriate, the reverse—by which a noun may be converted to a verb or adjective—might be undertaken.

In the historical development of exercise equipment, designs affecting portability, compatibility, safety and convenience in use have all become a matter of focus. The parent application from which the subject matter hereof derives addressed in considerable detail with reference to a solid handgrip (300) and certain versions of the strapped one (400) the aims of quickly adjusting the length of an elastic exercise member (200, 201, 202) or interchanging one thereof (200, 201, 202) for another (200, 201, 202). This application follows that conception into a particular type of strapped handgrip (20) comprising limitations differing from those addressed therein. The significance of this focus is best understood in terms of the field's history.

U.S. Pat. No. 27,611 issued to Bussey is characteristic of the first approaches to cord-handgrip interface. Because inelastic cord was employed, mere knotting was considered sufficient. U.K. Patent No. 16,404 issued to Wie/and; U.S. Pat. No. 1,112,114 issued to Caines; and U.S. Pat. No. 1,965,511 issued to Preston featured hooks and eyelets to that end.

U.S. Pat. No. 196,324 issued to Barnett comprises a 19th Century solution to the jump rope connection interface problem which an inelastic cord is doubled over and embedded within a plug (500) which is glued in place, the opening being merely capped off with a sealing plug. U.S. Pat. No. 232,579 issued to Weeks illustrates a braided type rope connection to rigid stirrup handgrips (300) with a system of snap-hook connections at intermediate places along a series of interconnected cords, some of which appear to be elastic (200). U.S. Pat. No. 4,109,907 issued to Zito illustrates a metallically clamped doubled over cord (200).

Assemblies eventually began to appear in which a hollow elastic exercise cord (200) was extended, or reeved, though part of a solid handgrip (300) and then stoppered by a plug (500) inserted therein. The cord (200) was thereby retained in place by what would appropriately be referred to herein as a connection of rigid attachment. U.S. Pat. No. 2,930,614 issued to McIntosh illustrated such a device, the patent also featuring a special stick-like tool to manipulate the plug (500), configured with an impaling tunnel within it (500) for the purpose. U.S. Pat. No. 4,779,867 issued to Hinds, the applicant herein, was another in which, as an incidental feature of the patented assembly, adopted a stoppering plug (500) for connection purposes. U.S. Pat. No. 5,681,248 issued to Vani provided an early model strapped handgrip in which the elastic tubing (200) was run through grommets and also secured by a stoppering plug (500). However, while the foregoing provided the security required for exercise purposes, none provided either for length adjustment or interchangeability of the elastic exercise member, whether cord (200), sheet (201) or strap (202).

Two patents of greater interest had emerged before the filing of the parent application from which this application was derived, however: U.S. Pat. No. 5,505,677 issued to Hinds, also the applicant herein and U.S. Pat. No. 5,549,532 issued to Kropp. Both patents disclose what is described herein, ante, as a certain type of elastic exercise member impinger (330).

The claims of the Hinds patent, for which the application was filed as early as Aug. 4, 1993, addressed innovations therein completely foreign to impingement of an elastic exercise member (200, 201, 202). However, one embodiment of the impinger (identified as 3 herein) which is an element of the subject matter hereof is shown in two of the drawings thereof and referenced in two paragraphs of the text. One might ponder the significance of that disclosure from which no claims were drawn. Although there is no textual description therein of the particular way in which the tethering loop (33 herein) is connected back upon itself (33), the first of the drawings suggests that connection means are present. Moreover, common experience informs one that the means must permit connection and disconnection without which, the mechanism would defeat its own purpose. It is not too difficult to envision a familiar prior art hook or snap structure of one shape or another. Certainly by reason of its Apr. 9, 1996 patenting, the impinger (3) thereof—described as a "spherical plug" comprising in turn a "ball" portion—would from that time forward constitute notice to the world of the means of impingement by which an impinger's head (31, 390) is forced against an elastic exercise member (200, 201, 202).

The Kropp patent issued Aug. 27, 1996, having been derived from an application filed while the Hinds one was yet pending, comprises claims addressing in part a frusto-conical—or cork shaped—impinger head (390). There is no specific reference to a configuration which is spherical (91) or to one which is, for example, lozenge shaped (92), a truncated sphere (93), ovate (94)—that is, like an egg—or bean shaped (95). It would be appropriate to adopt these neglected configurations, generally recognized by most, as enhancements within a useful assembly. Although the Kropp application also expressed the term "ball shaped" in three claims, there is no antecedent support for it in the disclosure. Because the expression in those instances is merely "ball shaped", it remains unclear whether anything beyond an amorphous mass, for which the term "ball" is frequently used in colloquial parlance, was intended. Kropp also claimed "locking means" which are similarly unsupported by antecedent precedent in the disclosure, although suggestive inferences might be drawn from the term "frictionally bear" expressed therein. There appears both in the disclosure and in drawings therein antecedent support for a shape which is designated therein only as "frusto-conical"—that is, a truncated cone. Thus, it is not quite clear what significance this patent offers concerning the prior art impinger (330). It would seem that while a head (390) specially shaped other than as a sphere (91) should be patentable, the Hinds disclosure preempted that shape (91) for any who followed. The logic urges that thenceforth, at least for the term of the patent, the Hinds head (91) might only be improved upon, if possible, or adopted in combination with other elements by one having no compunctions about foregoing exclusive rights in the spherical shape (91).

As for the Kropp impinger head (390), experience teaches that an elastic exercise member (200, 201, 202) impinged upon by an emplaced conical object, truncated (390) or otherwise, even in a prior art tapered nest (370) as shown therein, tends to become unsuitably abraded where, at the seating situs, it (200, 201, 202) is borne upon by the object's (390) angular edges. The property of roundness or arcuitry for the edge which contacts the elastic exercise member (200, 201, 202) in impingement would, if provided, be highly preferred to the straightness comprised by a truncated cone (390).

Arcuate or rounded configuration permits the prior art impinger (330) to contact the elastic member (200, 201, 204 in a manner less likely to abrade it (200, 201, 202) by means of sharp marginal edges such as those comprised by the truncated cone-shaped one (390)—sometimes referred to as "frusto-conical"—of prior art. An arcuate or rounded edge also seats against the elastic member (200, 201, 202) in an optimum manner, depending upon the mutual positioning of the two (330 and 200, 201, 202, respectively, whereas the straight edge of prior art comprised by Kropp's truncated cone (390) necessarily seats in singular fashion—always along part of its (390) straight side. An arcuate edge would, if provided, comprise the highly beneficial property of seating against the elastic member (200, 201, 202) within the elastic member channel (6) along a circumferential line comparable to the latitude lines or equator of a globe.

And even then, the issue has become clouded by yet another patent. On Apr. 20, 1999, in the face of the almost two year-old Hinds and Kropp patents and during the pendency of the parent application hereof, the Chiu application, ultimately emanating in U.S. Pat. No. 5,894, 631, was filed. In it, the familiar spherically shaped head (91) was again featured with a special tethering mechanism (34) extending from it (91). The tether (340) required the fitting or snapping together of two members—one of a totally separate piece suggestive of a small key in function and which under not too unusual circumstances, could presumably become lost. While improved tethers (340) are clearly a goal worthy of pursuit, it would seem more enlightening to return to the unified, integral one-piece versions of Hinds and Kropp, rather than resort to one divided into separate parts.

Yet, the impinger (3 herein, 330 at prior art) is really no better than the assembly it is part of. The foregoing three patents addressed the (impinger's (3 herein, 330 at prior art) use only in the solid handgrip (300). Indeed, the parent application from which this application derives included a specially designed solid handgrip (300) in its claims to novelty. As appealing in certain respects as the solid handgrip (300) is, there are several aspects to the strapped handgrip (20 herein, 400 at prior art) which to some make it preferable to the solid one (300) such as, at the manufacturing level, more plentiful availability of ingredient materials and reduced production cost; and at the consumer level, softer feel upon the hands and stowage compatibility. It is, therefore, incumbent upon those with imagination to fashion impinging systems suitable for the latter (20, 400).

Applicant has resolved that the distinct advantages of combining with the strapped handgrip (400) known in other respects to prior art, an elastic exercise member impinger (3, ante) comprising a rounded or arcuate exterior and a dependable tether (4, ante) should be brought to public attention.

While the historical developments supra as well as the subject matter of the application which is the parent hereof have fairly well addressed the matter of elastic cord (200) and solid handgrip (300) interface for security purposes, the problems of quickly adjusting the length of any elastic exercise member, whether cord, sheet or strap (200, 201, 202, respectively) or interchanging one of them (200, 201, 202) for another (200, 201, 202) remain for the strapped handgrip (20,400). The needs and objectives pointed out supra thus far remain only partly addressed in the prior art. Some, such as that just immediately addressed, have not been met at all.

SUMMARY OF THE INVENTION

The invention is an exercise assembly combination incorporating certain novel features with a handgrip of strapped configuration (20)—that is, one wherein handgrip strapping (600) is employed.

One of the invention's main features comprises an elastic member impinger (3) for use in quickly and conveniently adjusting the effectual length of an elastic exercise member (200, 201, 202) secured between a pair of strapped handgrips (20) or interchanging such members (200, 201, 202). The impinger (3) becomes seated in a nest (5) disposed within the member channel (6) such that it (3) squeezes against the elastic member (200, 201, 202) and is retained there (5) during exercise.

The nest (5) reposes within an elastic exercise member channel (6) disposed within a connection bar (21) configured to both accommodate the handgrip strapping (600) and provide a situs for elastic member (200, 201, 202) security. The equivalent prior art fully tapered nest (700) or parallel walls of the elastic member channel (6) is modified to provide any one of a number of improved nests (5) comprising configuration including concave (51), convex (52) or partially tapered (53).

It is the impinger's head (31), comprising any of a variety of arcuately edged configurations—spherical (91), lozenge shaped (92), truncated sphere (93), ovate (94) or bean shaped (95)—which accomplishes the impinging task.

In addition to the head (31), the elastic member impinger (3) also comprises a stem (32) and impinge tether (4). The latter (4) is configured either with a tethering loop (33) and impinger connector guide (34) combination or with a tethering stop (43).

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

FIG. 1 represents in perspective a strapped handgrip assembly (20) in which the impinger's tether (4) comprises a tethering loop (33) connected to handgrip strapping (600). The impinger head (31), spherically shaped (91) in this instance, is shown ready for emplacement within the member channel (6) of the grip's connection bar (21).

FIG. 2 comprises a close-up view of a tether (4) comprising the loop (33) with typical configuration for the tethering hook (35) and connector guides (34). A serrated sector (36) to enhance gripping security is shown disposed upon the hook (35).

FIG. 3 illustrates an operator's (100) pressured emplacement of a spherical impinger head (31, 91) into the member channel (6) of a strapped handgrip (400). The tethering loop (33) is shown encircling the strapping (600).

FIGS. 4–8 depict cross-sectional views of variously configured impinger heads (31) within the member channel (6) of a strapped grip (20). The strap channels (22) are also shown. In FIG. 4, the head (31) is spherical (91) and the impinger's stem (32) is shown bent upwards to demonstrate a degree of flexibility. In FIGS. 5–8, the heads (31) respectively are lozenge shaped (92)—which includes the ellipsoid and oval shapes; truncated sphere (93); ovate, or egg shaped (94); and bean shaped (95). In FIG. 5, the elastic member comprises elastic an exercise strap (202) and in FIG. 6, elastic exercise sheet (201).

FIG. 10, a plugged (500) elastic exercise cord (200); and FIG. 11, a truncated cone impinger head (390).

DESCRIPTION OF THE PREFERRED EMBODIMENT

Figure 5:
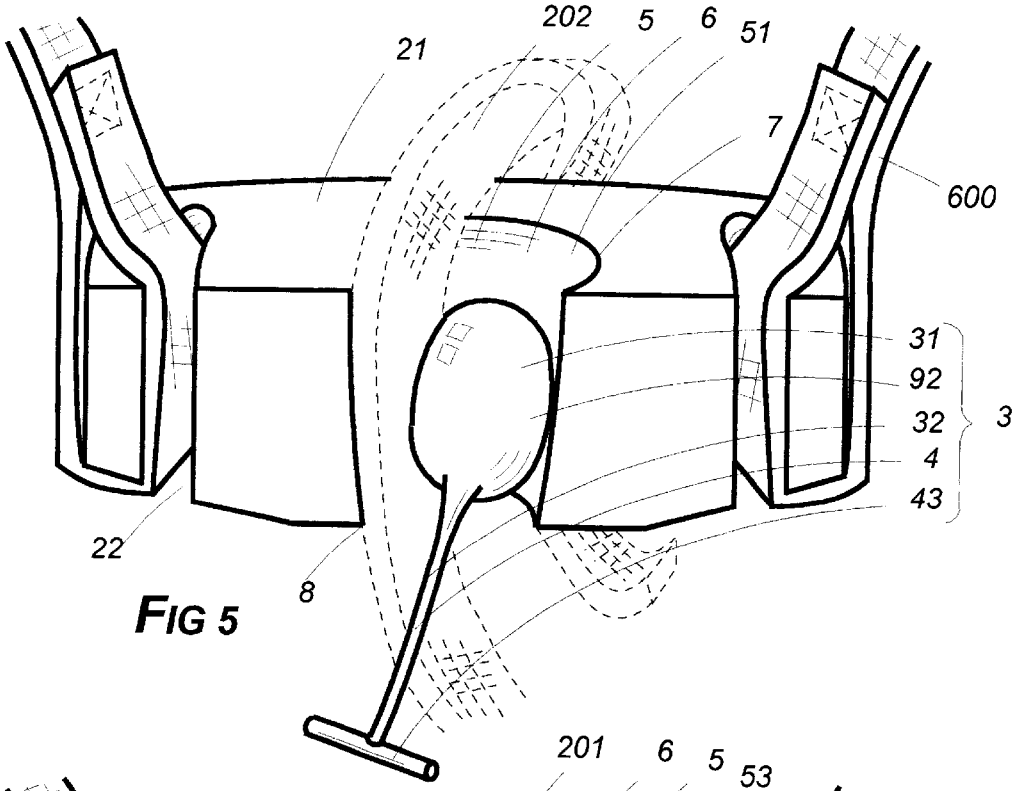

The subject of this application is a strapped handgrip exercise assembly (20) representing a departure from prior art strapped handgrips (400) which, by reason of the matters addressed herein, respectively comprise significant features of improvement.

The characteristic of novelty comprises in part means by which the effectual length of the elastic exercise cord (200), sheet (201), or strap (202), of an exercise assembly may be quickly adjusted—that is, either shortened or lengthened—or interchanged with others of varying elasticity. Adjustment of the elastic member's (200, 201, 202) effectual length is accomplished by inserting one of it's (200, 201, 202) ends through the handgrip's elastic exercise member channel (6), ante—into the exterior elastic member channel end (8) and allowing it to emerge through the interior channel end (7)—and then impinging it (200, 201, 201) securely at a point along its (200, 201, 202) midlength within the channel (6). A portion of its length is thereby removed from active use and merely allowed to stick out, or hang loosely from the assembly. The remaining portion of the elastic member (200, 201, 202), extending between the handgrips of the assembly (20), is thereby dedicated for active use.

The essential parts of this feature of the invention comprise an elastic member impinger (3), a separate article which is emplaced within the channel (6), and an elastic member channel nest (5) disposed within it (6).

One can readily conceive of even a straight walled channel (6) containing both the penetrating elastic cord (200) or other member (201, 202) and an impinger (3), the situs of which is referred to herein as a nest (5), which provides acceptable squeezing force to retain the cord (200) or member (201, 202) in place. It should be readily apparent, however, that a specially formed nest (5), such as one comprising concave or any other configuration which allows the head (31) to seat securely, provides considerably greater impinging security.

Figure 6:
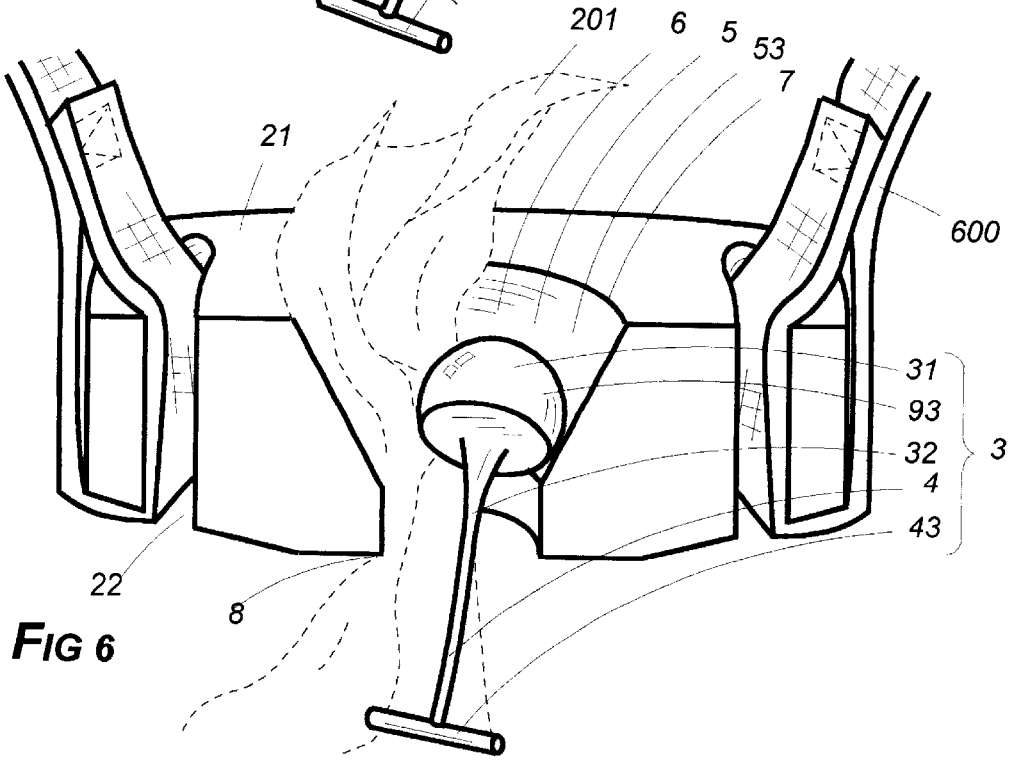
Figure 7:
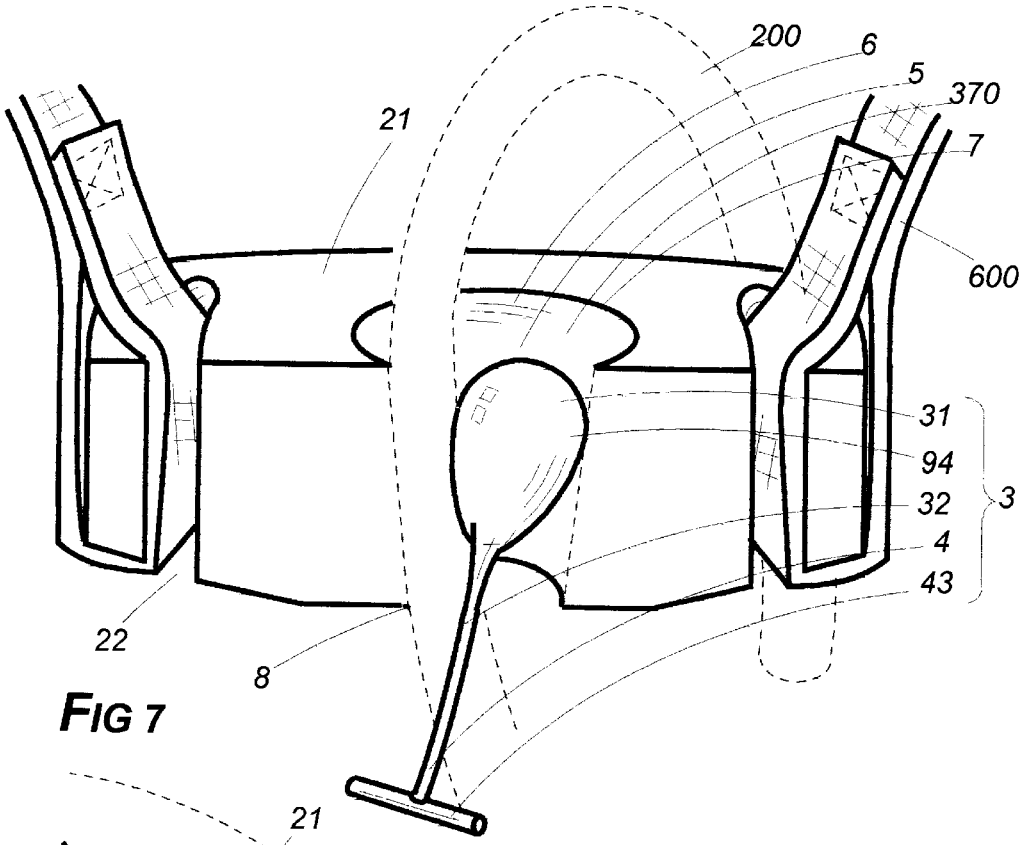
Figure 8:
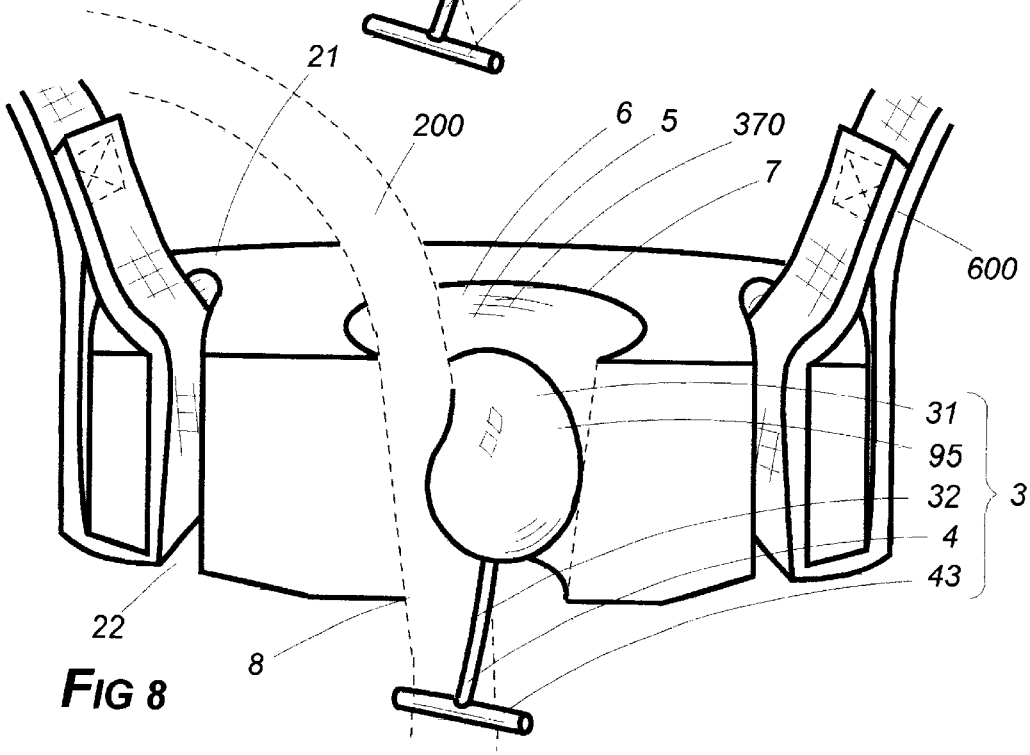
Figure 9:
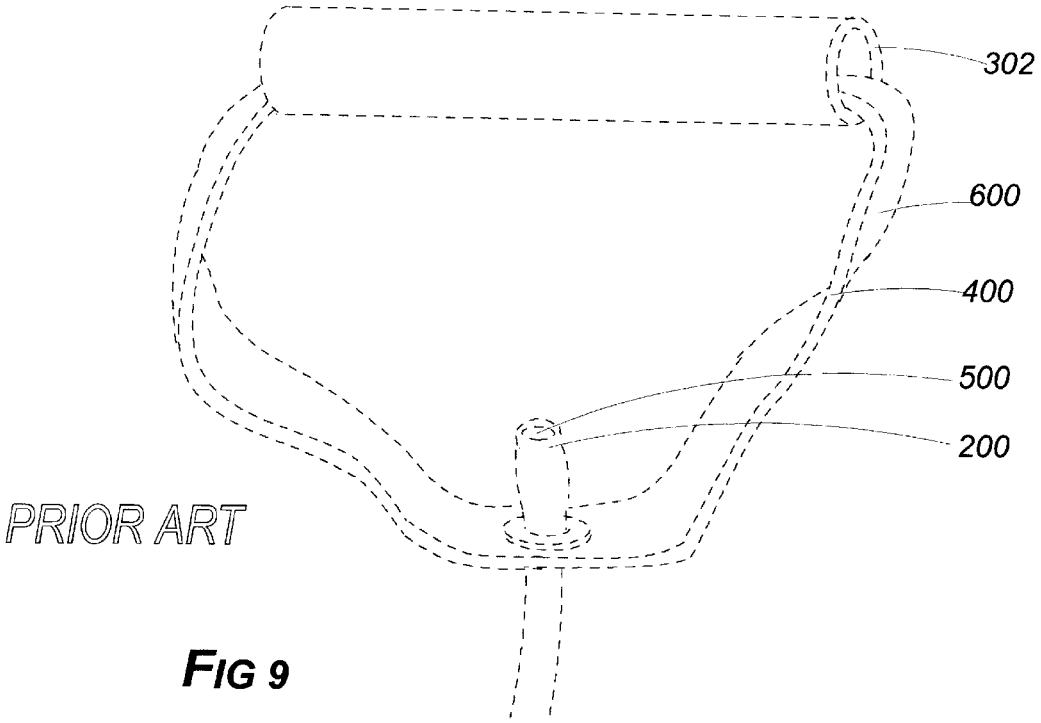
FIGS. 9–11 represent prior art devices in which FIG. 9 comprises a typical strapped handgrip (400)
Figure 10:
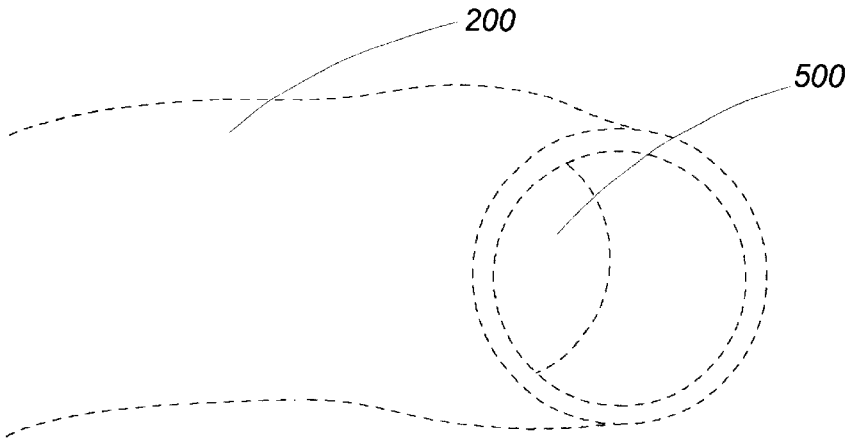
FIG 10 PRIOR ART
Figure 11:
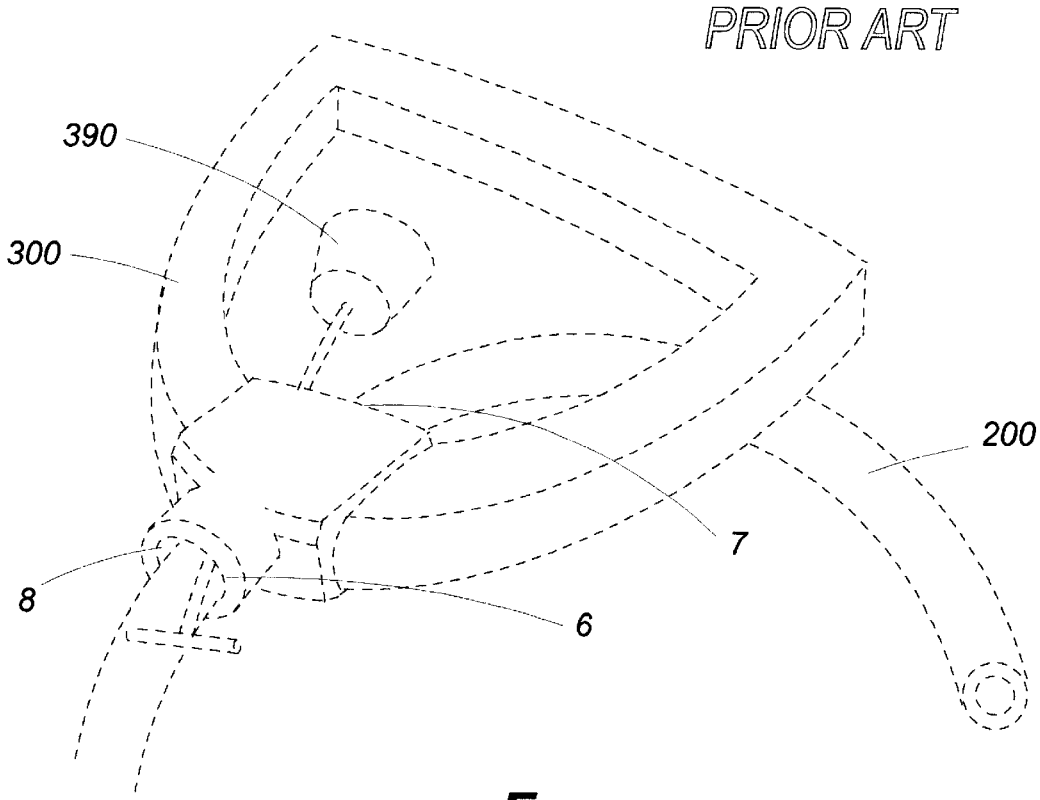

The strapped handgrip herein (20) comprises a departure from that (400) of prior art primarily by incorporating a connection bar (21). As illustrated in FIGS. 1 and 3–8, this constituent of the invention comprises a solid situs wherein are present opposing pairs of strap channels (22) together with the same elastic member channel (6) and nest (5) which were featured in the parent application for both a solid handgrip (300) and a differently embodied strapped handgrip (20).

The opposing pair of strap channels (22) provide conduits through which, in manufacture, each end of the handgrip strapping (600) may be run and attached by stitchwork back upon itself (600) in loops to keep it (600) in place as in FIGS. 1 and 3–8.

FIG. 1 also includes a tubular palm hold (302), another optional prior art ingredient preferably enwrapped in foam. Since stitching is shown to have been employed to attach the strapping (600) there, the palm hold (302) is easily mounted in place during manufacture but afterwards impossible to remove without undoing the stitching or cutting the strapping (600). The tubular configuration permits the hold (302) to spin, or rotate, upon the strapping (600) extending through it (302).

The combination of elastic member impinger (3) and member channel nest (5) embody a crucial feature of the invention in providing the impingement required to effectually lengthen or shorten the elastic exercise member (200,

201, 202). Exercise stresses upon the handgrip assembly (20) during use by the operator (100) tend to strengthen the impingement. The harder the elastic member (200, 201, 202) is pulled, the tighter the interface connection becomes.

As already alluded to, the part of the impinger (3) which provides the impingement comprises an impinger head (31), a knob-like structure which merely by reason of its (31) mass is caused to bear against the elastic member (200, 201, 202) extending through the member channel (6) when tugged through at the channel's exterior end (8). Pushing the elastic member (200, 201, 202) in the opposite direction—from the channel's exterior end (8) to its interior end (7)—releases the impinger head (31) from the nest (5) so that the member (200, 201, 202) may be operatively changed in effectual length or, provided the same operation is performed upon some other handgrip assembly (20), interchanged with another member (200, 201, 202).

As the drawings reveal, the head (31) may be configured in any number of ways including spherical (91), lozenge shape (92), truncated sphere (93), ovate (94) and bean shape (95). The spherical shape (91) is, of course, well recognized as an object having equal radius in all directions. Lozenge shape (92), as used herein defines that portraying elongated longitudinal symmetry such as comprised by an ellipse or oval. A truncated spherical shape (93) depicts that of a sphere which has a portion comprising that disposed between a cross-section and the end thereof—such as a hemisphere, for example. Another example may be visualized by severing a globe in two parts along any one of its latitude lines, such that the two parts are unequal. Ovate (94) configuration comprises that which is egg shaped—elongated but lacking longitudinal symmetry in that the cross-sectional diameter is greater at one end than the other. By bean shaped (95) configuration is meant that which is longitudinally curved—sometimes referred to as "kidney shaped"—comprising two sides which are generally parallel in concavity. All of these comprise in common a feature crucial to the invention—an arcuate outer edge.

Functionally, the impinger's head (31) is all that is required to provide interface security. However, if the member impinger (3) comprised nothing more, it would easily become lost or misplaced. The impinger (3), therefore, has been additionally configured with structure to secure itself (3) to the handgrip assembly (20).

The impinger tether (4) comprises any means known to prior art required for connecting various relatively small objects for stowage purposes. That depicted in FIGS. 1–3 comprises an impinger tethering loop (33) which is operably looped around a convenient part of the handgrip assembly (20) and then secured, somewhat resembling a lariat, or lasso, in appearance. It is preferable that the size of the loop (33) be small enough to prevent its (33) slipping away from a handgrip connection bar (21) or strapping (600) it (33) is tethered to. The size of the loop is controlled by the disposition of the immobile impinger connector guides (34) along the stem (32)—a matter necessarily determined at time of manufacture.

Each tether (4) shown in FIGS. 4–8, however, comprises an impinger stop (43)—a T-shaped structure which by reason of its (43) transverse cross member—the head of the 7 so to speak—provides the required security by blocking passage through the channel (6) in which the impinger (3) is disposed. Although differing considerably in size and function, in certain respects, this part of the structure (43) resembles the smaller plastic price and size tag connectors one finds in retail clothing.

The impinger stop (43) shown is merely rod-shaped but may, in fact, take any one of several forms. It (43) may, for example, be somewhat planular or disk-shaped. It is the transversity of the configuration, not the specific shape—that is, whether rod-like or disk-like—which provides the necessary anchoring character.

The function the stop (43) may, therefore, be considered to provide is merely for stowage of the impinger (3), so as to avoid its (3) becoming lost or overlooked. It (43) need not, therefore, be as durable in structure as are the parts of the strapped assembly (20) subjected to extreme tensions. Nevertheless, the material of which the stem (32) and it (43) are comprised must be adequate to perform their (32, 43) intended function. First, the two parts (32, 43) must be allowed to bend without breaking at their (32, 43) mutual joint so as to permit insertion through the elastic member channel (6). Second, they (32, 43) must be flexible enough to spring back into their mutually transverse configuration. Finally, the stop (43) must be strong enough to afterwards remain in place without becoming accidentally pulled through the channel (6). These requirements are fairly obvious for the tether (4) of the shorter stemmed elastic member impinger (3) with its (3) T-shaped stop (43). However, an impinger (3) with sufficient elongation in the stem (32) to permit anchoring it (32) around a part of the handgrip assembly (20) by means of its tether (4) comprising a tethering loop (33) is subjected to similar stresses.

TABLE I

| PP5420 A1 GLASS REINFORCED HOMOPOLYMER 20% GLASS FIBER FILLER | |
|---|---|
| Tensile Strength[1] | 9,750 psi |
| Tensile Elongation[1] | 3% |
| Break[1] | 3% |
| Flexural Module Secant[2] | 500,000 psi |
| Flexural Module Tangent[2] | 750,000 psi |
| Heat Deflection 66 psi[3] | 305° F. |
| Heat Deflection 264 psi[3] | 285° F. |
| Specific Gravity[4] | 1.05 |
| Notched Izod Impact 23° C.[5] | 1.30 |
| Melt Flow 230° C./2.16 kg[6] | 10.0 |
| Linear Shrinkage[7] | 0.40% |

METHOD
[1]ASTM D636
[2]ASTM D790
[3]ASTM D646
[4]ASTM D792
[5]ASTM D256
[6]ASTM D1,238
[7]23° C./24 hrs/3.2 mm thick
Courtesy Ashland Chemical
General Polymers
90 W. Chestnut St
Washington PA 15301
(412) 225-2220

TABLE II

| REXENE PP 18S2A POLYPROPYLENE COPOLYMER | |
|---|---|
| Density[1] | 0.9000 g/cm$^3$ |
| Melt Flow 230° C./2.16 kg[2] | 2.0 g/10 min |
| Mold Shrink, Linear-Flow[3] | 0.015–0.025 in/in |
| Tensile Modulus[4] | 170,000 psi |
| Tensile Strength @ Yield[4] | 3,500 psi |
| Tensile Elongation @ Brk[4] | 700% |
| Flexural Modulus[5] | 160,000 psi |
| Notched Izod Impact 73° F.[6] | 15.0 ft-lb/in |
| Gardner Impact 73° C.[7] | 320 in-lb |

TABLE II-continued

| REXENE PP 18S2A POLYPROPYLENE COPOLYMER | |
|---|---|
| Gardner Impact −40° F.[7] | 300 in-lb |
| Rockwell Hardness (R-Scale)[8] | 70.0 |
| DTUL @ 66 PSI - Unannealed[9] | 199° F. |

METHOD
[1]ASTM D1,505
[2]ASTM D1,238
[3]ASTM D955
[4]ASTM D638
[5]ASTM D790
[6]ASTM D256
[7]ASTM D3,029
[8]ASTM D785
[9]ASTM D648
Courtesy IDES, Inc For the foregoing reasons, it is important that the elastic member impinger (3) be comprised of tested materials. Table I lists such properties for Polypropylene PP5420, 20% glass reinforced, chemically coupled homopolymer. Table II lists them for Rexene PP 1852A Polypropylene Copolymer.

An impinger stem (32) interconnects the head (31) and tether (4) and may be of more or less indeterminate elongation. The stem (32) required for the loop connection shown in FIGS. 1–3 are shown to be longer than those (32) for the transverse stopping connections shown in FIGS. 4–8. The stem (32) attached to an impinger stop (43), however, could be equal in length to that (32) of the tethering loop (33) without impeding function. Where stem (32) length is concerned, it is only necessary to insure that one attached to a tethering loop (33)is sufficient to enable an operator (100) to tether it (32) easily. It (32) may be loosely connected to any convenient part of the handgrip assembly (20). It (32) may, for example, be either looped around the strapping (600) or passed through one of the strap channels (22) of the connection bar (21).

In a preferred embodiment, the connecting part of the tethering loop (33) is configured generally in the shape of a relatively small hook (35) as shown in FIGS. 1–3, although it may take any prior art form which accomplishes a connection which, though somewhat loose, is just tight enough to avoid the loop's (33) slipping off and which allows the operator (100) to connect and disconnect it (35) quickly. Thus, a device such as the familiar one employed at prior art to connect a bit tightening wrench to an electric drill would not do, for example, because of the configuration it has to make the connection relatively permanent. A suitable embodiment of the connector (35) comprising the quick connection and disconnection properties required for the subject matter hereof preferably comprises a serrated sector (36) as shown in FIG. 2. If present, it (36) should be disposed such that the serrations—or pointed protrusions—thereof (36) impinge against the loop (33) to hold it (33) in place. The hook (35) may be shaped in any manner which permits it to be brought against the loop (33) between the connector guides (34), ante, and be retained in place there. The one (35) shown in FIG. 2 is configured in a manner consistent with that known to the art.

In the embodiment shown in FIGS 1–3, that which is preferred, the tethering loop (33) is retained in place by means of a pair of connector guides (34). These (34) comprise bumps, or protrusions, situated at a site along the general midlength of the stem (32). The exact disposition is a matter of preference and depends generally upon the size loop desired. The two guides (34) are separated on the stem (32) by approximately ⅛–3/16 inch. They (34) should be disposed such that the hook (35) may be seated between them in making the required connection. The exact distance is not critical to function so long as they (34) are in position to prevent the connection from becoming undone.

The nest (5) within the member channel (6) disposed in the connection bar (21) of the assembly (20) may comprise any form which facilitates the squeezing function of the impinger head (31). It (5) may be tapered (370) as it (5) is in prior art and shown in FIGS. 7and 5, convex (52) as in FIG. 4, concave (51) as in FIG. 5, partially tapered (53) as in FIG. 6, or have any other convenient shape. A channel (6) comprising a straight or parallel wall is not preferred, however, because of the risk the impinger (3) might pull all of the way through it (6).

It should also be recognized that the connection bar (21), an important part of the strapped configured handgrip assembly (20) may also be employed as part of other exercise system combinations such as exercise belts, headgear or other constructions which are fitted to some part of the operator's (100) body. Although not considered an emplaceable part of the assembly, usually requiring attachment by stitchwork in manufacture, it (21) may be considered as a separate novelty on its own merit.

The inventor hereby claims:

1. An adjustable exercise handgrip assembly comprising:

an elastic exercise member impinger in turn comprising
- a head;
- a stem; and
- a tether comprising one of
  - a tethering loop; and
  - a stop;

the adjustable exercise handgrip assembly further comprising strapped configuration comprising
handgrip strapping; and
- a connection bar comprising
  - a pair of strap channels; and
  - an elastic exercise member channel in turn comprising an impinging nest;

wherein each end of the strapping is disposed to run though the strap channels and attached by stitchwork back upon itself in loops;

whereby an operator, upon inserting a portion of the elastic exercise member through the elastic member channel and emplacing the impinger within the channel nest, may quickly change the effectual length of the elastic member or interchange it with another.

2. The adjustable handgrip assembly according to claim 1 wherein the impinging nest comprises concave configuration.

3. The adjustable handgrip assembly according to claim 1 wherein the impinging nest comprises convex configuration.

4. The adjustable handgrip assembly according to claim 1 wherein the impinging nest comprises partially tapered configuration.

5. The adjustable handgrip assembly according to claim 1 wherein the impinger head comprises spherical configuration.

6. The adjustable handgrip assembly according to claim 1 wherein the impinger head comprises truncated spherical configuration.

7. The adjustable handgrip assembly according to claim 1 wherein the impinger head comprises lozenge shaped configuration.

8. The adjustable handgrip assembly according to claim 1 wherein the impinger head comprises ovate configuration.

9. The adjustable handgrip assembly according to claim 1 wherein the impinger head comprises bean shaped configuration.

10. The adjustable handgrip assembly according to claim 1 wherein the elastic member impinger tethering loop comprises hook configuration.

11. The adjustable handgrip assembly according to claim 1 wherein the elastic member impinger stem comprises a pair of impinger connector guides disposed such that the tethering hook may be seated between them in connecting the tethering loop back upon itself.

12. The adjustable handgrip assembly according to claim 1 wherein the strapped handgrip assembly comprises a tubular palm hold.

* * * * *